US008241001B2

(12) United States Patent
James

(10) Patent No.: US 8,241,001 B2
(45) Date of Patent: Aug. 14, 2012

(54) STATIONARY TURBINE COMPONENT WITH LAMINATED SKIN

(75) Inventor: Allister W. James, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 968 days.

(21) Appl. No.: 12/204,138

(22) Filed: Sep. 4, 2008

(65) Prior Publication Data

US 2010/0054933 A1 Mar. 4, 2010

(51) Int. Cl.

| | |
|---|---|
| ***B63H 1/26*** | (2006.01) |
| ***B63H 7/02*** | (2006.01) |
| ***B64C 27/46*** | (2006.01) |
| ***F01D 5/14*** | (2006.01) |
| ***F03B 7/00*** | (2006.01) |
| ***F03D 11/02*** | (2006.01) |
| ***F04D 29/38*** | (2006.01) |

(52) U.S. Cl. ..... 416/224

(58) Field of Classification Search ..... 416/229 A, 416/229 R, 235, 231 B, 226

See application file for complete search history.

(56) References Cited

U.S. PATENT DOCUMENTS

| | | | | |
|---|---|---|---|---|
| 4,157,880 | A | 6/1979 | Klompas | |
| 4,573,872 | A | 3/1986 | Nakata | |
| 5,236,151 | A | 8/1993 | Hagle et al. | |
| 5,242,264 | A | 9/1993 | Kojima et al. | |
| 5,246,340 | A | 9/1993 | Winstanley et al. | |
| 5,621,968 | A | 4/1997 | Kikkawa et al. | |
| 5,720,597 | A | 2/1998 | Wang et al. | |
| 5,820,337 | A | 10/1998 | Jackson et al. | |
| 5,875,549 | A | 3/1999 | McKinley | |
| 6,322,322 | B1 | 11/2001 | Rhodes et al. | |
| 6,709,230 | B2 | 3/2004 | Morrison et al. | |
| 7,153,096 | B2 * | 12/2006 | Thompson et al. | 415/200 |
| 7,247,002 | B2 * | 7/2007 | Albrecht et al. | 416/224 |
| 7,828,515 | B1 * | 11/2010 | Kimmel | 415/115 |
| 2002/0117601 | A1 | 8/2002 | Keller et al. | |
| 2004/0021828 | A1 | 2/2004 | Evans et al. | |
| 2004/0184921 | A1 | 9/2004 | Schreiber | |
| 2005/0221109 | A1 | 10/2005 | Torigoe et al. | |
| 2006/0099080 | A1 | 5/2006 | Lee et al. | |
| 2006/0216154 | A1 | 9/2006 | McMillan | |
| 2010/0054930 | A1 * | 3/2010 | Morrison | 415/191 |

FOREIGN PATENT DOCUMENTS

| | | |
|---|---|---|
| JP | 58-047103 | 3/1983 |
| JP | 58-172406 | 10/1983 |
| JP | 60-182303 | 9/1985 |
| JP | 2004-285864 | 10/2004 |
| WO | WO99/33605 | 7/1999 |

* cited by examiner

*Primary Examiner* — Ha Tran T Nguyen
*Assistant Examiner* — Valerie N Brown

(57) ABSTRACT

A stationary turbine engine component, such as a turbine vane, includes a internal spar and an external skin. The internal spar is made of a plurality of spar laminates, and the external skin is made of a plurality of skin laminates. The plurality of skin laminates interlockingly engage the plurality of spar laminates such that the external skin is located and held in place. This arrangement allows alternative high temperature materials to be used on turbine engine components in areas where their properties are needed without having to make the entire component out of such material. Thus, the manufacturing difficulties associated with making an entire component of such a material and the attendant high costs are avoided. The skin laminates can be made of advanced generation single crystal superalloys, intermetallics and refractory alloys.

20 Claims, 5 Drawing Sheets

STATIONARY TURBINE COMPONENT WITH LAMINATED SKIN

STATEMENT REGARDING FEDERALLY SPONSORED DEVELOPMENT

Development for this invention was supported in part by Contract No. DE-FC26-05NT42644 awarded by the United States Department of Energy. Accordingly, the United States Government may have certain rights in this invention.

FIELD OF THE INVENTION

Aspects of the invention relate in general to turbine engines and, more particularly, to stationary components in the turbine section of a turbine engine.

BACKGROUND OF THE INVENTION

A turbine engine includes a compressor section, a combustor section and a turbine section. Some components exposed to hot gases during engine operation, such as a turbine vane, are made of nickel-based superalloys. While such materials have proved to be generally adequate under prior operating conditions, the industry drive toward increased turbine operating temperatures is challenging the material capabilities of nickel-based superalloys. Alternative high temperature capable materials are commercially available, but the introduction of such materials into gas turbine components has not occurred because their cost and the extreme difficulty of manufacturing complex monolithic parts from these materials. Thus, there is a need for a system that can facilitate the inclusion of various high temperature capable materials in turbine engine components.

SUMMARY OF THE INVENTION

Aspects of the invention are directed to a stationary turbine engine component. The component includes an internal spar and an external skin. The internal spar is made of a plurality of spar laminates. Each spar laminate can include a body portion having at least one planar surface. The planar surface of each spar laminate can abut the planar surface of a neighboring spar laminate. Each spar laminate can have an outer peripheral surface.

The external skin is made of a plurality of skin laminates. Each of the external skin laminates can be made of advanced generation single crystal superalloys, intermetallics, nickel-based intermetallics, refractory alloys or oxide dispersion strengthened alloys. In one embodiment, each of the external skin laminates can be made of a material that can withstand a minimum of about 1300 to about 1400 Celsius. At least a portion of one or more of the skin laminates can be coated with an environmental barrier coating.

Each external skin laminate has an outer wall and a retention portion. The retention portion of each skin laminate is disposed between and in interlocking engagement with two neighboring spar laminates. As a result, the skin laminates are held in place by their interlocking engagement with the spar laminates. In one embodiment, the skin laminates can be held in place solely by their interlocking engagement with the spar laminates; thus, no other structure is used to hold the skin laminates in place.

The outer wall of each skin laminate can be spaced from the outer peripheral surface of each spar laminate that it interlockingly engages. As a result, a cavity is defined therebetween. The retention portion of each skin laminate can include a bridge portion that extends inward from the outer wall. The bridge portion can include one or more passages extending therethrough. The passages can be in fluid communication with the cavity.

The outer wall of each skin laminate can include an upper end surface and a lower end surface. The upper end surface and/or the lower end surface of each skin laminate can abut an opposite one of the upper end surface and the lower end surface of a neighboring skin laminate. For instance, the upper end surface of one skin laminate can abut the lower end surface of a first neighboring skin laminate. Alternatively or in addition, the lower end surface of the same skin laminate can abut the upper end surface of a second neighboring skin laminate. An interface can be formed between the abutting surfaces of the outer walls of neighboring skin laminates. The interface can be angled relative to horizontal.

The retention portion of each skin laminate can include a bridge portion that extends inward from the outer wall and transitions into a transverse engaging portion. The bridge portion and the engaging portion can collectively be generally T-shaped in cross-section.

In another aspects, embodiments of the invention are directed to a stationary turbine engine component. The component includes a first internal spar laminate, a second internal spar laminate and an external skin laminate.

Each spar laminate includes a body portion that has a substantially planar upper surface and a substantially planar lower surface. Each of the first and a second internal spar laminates further includes a retention portion that extends at least partially about the body portion. Each retention portion includes a bridge portion extending outward from the body portion. The bridge portion transitions into a transverse engaging portion that defines an outer peripheral surface of each of the spar laminates. In one embodiment, the retention portion of each of the first and second spar laminates can be generally T-shaped in cross-section.

The external skin laminate has an outer wall and a retention portion. The outer wall can include an upper end surface and a lower end surface. The upper end surface and the lower end surface can be angled relative to horizontal. The retention portion of the skin laminate includes a bridge portion that extends inward from the outer wall. The bridge portion transitions to a transverse engaging portion. In one embodiment, the retention portion of the skin laminate can be generally T-shaped in cross-section. The skin laminate can be made of one of advanced generation single crystal superalloys, intermetallics, nickel-based intermetallics, refractory alloys and oxide dispersion strengthened alloys.

The laminates are arranged so that the retention portion of the skin laminate is disposed between and in interlocking engagement with the retention portion of first and second spar laminates. Further, the upper planar surface of the first spar laminate is substantially adjacent to the lower planar surface of the second spar laminate. In addition, the outer wall of the skin laminate is spaced from the outer peripheral surface of each spar laminate. The skin laminate can be held in place solely by its interlocking engagement with the first and second spar laminates.

Another aspect of the invention is directed to a turbine vane assembly, which includes an inner shroud, an outer shroud, and an airfoil extending between and operatively engaging the inner shroud and the outer shroud. The airfoil includes an internal spar made of a plurality of generally airfoil shaped spar laminates and an external skin made of a plurality of generally airfoil shaped skin laminates.

Each spar laminate includes a body portion and a retention portion extending at least partially about the body portion.

Each external skin laminate has an outer wall and a retention portion. The retention portion of each skin laminate is disposed between and in interlocking engagement with the retention portion of two neighboring spar laminates. Each skin laminate is held in place by interlocking engagement with the spar laminates. At least one end of the outer wall of each skin laminate abuts an end of the outer wall of a neighboring skin laminate. Each skin laminate is made of advanced generation single crystal superalloys, intermetallics, nickel-based intermetallics, refractory alloys or oxide dispersion strengthened alloys.

Each spar laminate can have an outer peripheral surface. The retention portion of each skin laminate can include a bridge portion that extends inward from the outer wall. The bridge portion can transition into a transverse engaging portion. The outer wall of each skin laminate is spaced from the outer peripheral surface of each spar laminate that it interlockingly engages. As a result, a plurality of cavities can be formed between the outer wall of the skin laminates, the outer peripheral surface of the spar laminates and the bridge portion of each skin laminate. One or more of the cavities can be in fluid communication with a neighboring cavity by way of passages that extend through the bridge portion of the skin laminate that separates neighboring cavities.

DETAILED DESCRIPTION OF EMBODIMENTS OF THE INVENTION

Embodiments of the invention are directed to a stationary turbine engine component assembly that can accommodate the use of various high temperature capable materials. Aspects of the invention will be explained in connection with a turbine vane, but the detailed description is intended only as exemplary. Embodiments of the invention are shown in FIGS. 1-5, but the present invention is not limited to the illustrated structure or application.

Figure 1:
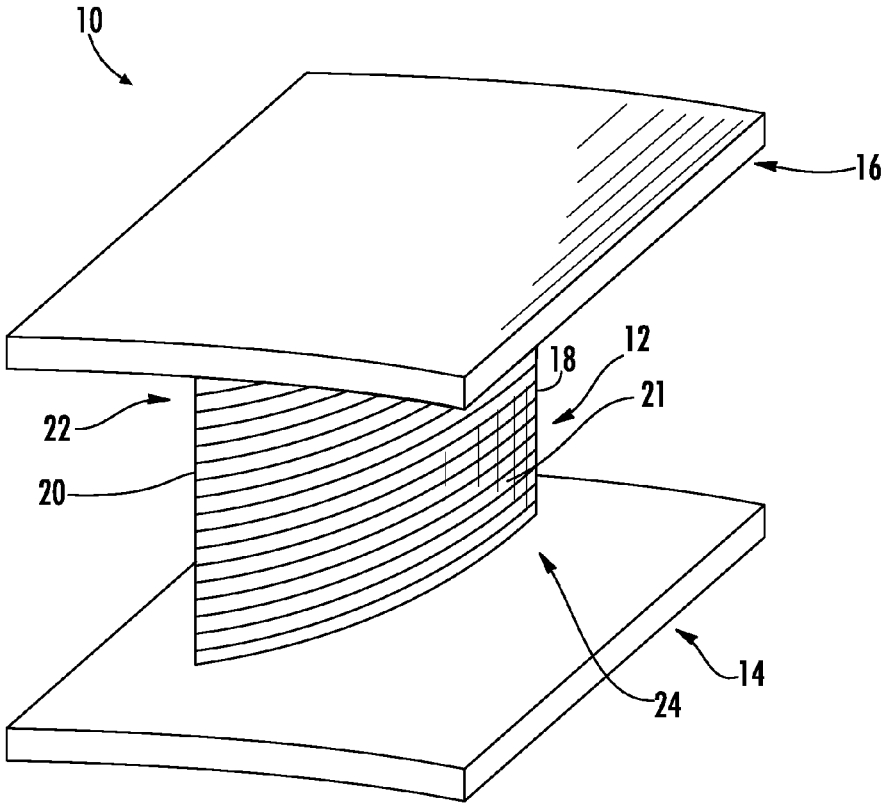
FIG. 1 is a perspective view of a turbine vane assembly according to aspects of the invention.
Figure 2:
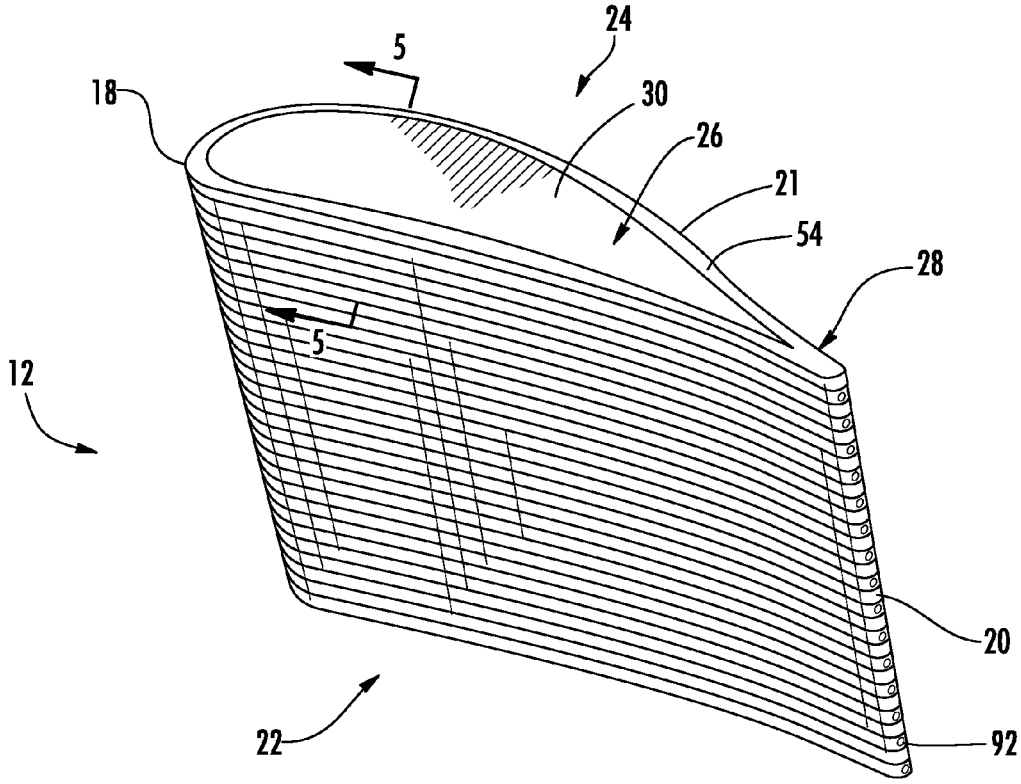
FIG. 2 is perspective view of an airfoil portion of a turbine vane assembly according to aspects of the invention.

FIG. 1 shows a turbine vane assembly 10 according to aspects of the invention. As shown, the turbine vane assembly 10 includes an airfoil 12, an inner shroud 14 and an outer shroud 16. At the outset, it is noted that the terms "radial," "inner," "outer," "upper," and "lower" and variations of these terms, as used herein, are intended to mean relative to the turbine axis when the turbine vane assembly is installed in its operational position. The airfoil 12 can have a leading edge 18, a trailing edge 20, an outer peripheral surface 21, a pressure side 22 and a suction side 24. According to aspects of the invention, the airfoil 12 can include an internal spar 26 and an external skin 28, as shown in FIG. 2. The internal spar 26 can provide the structural strength to the airfoil 12. As will be described in more detail later, the internal spar 26 can also retain the external skin 28 in position.

Figure 3:
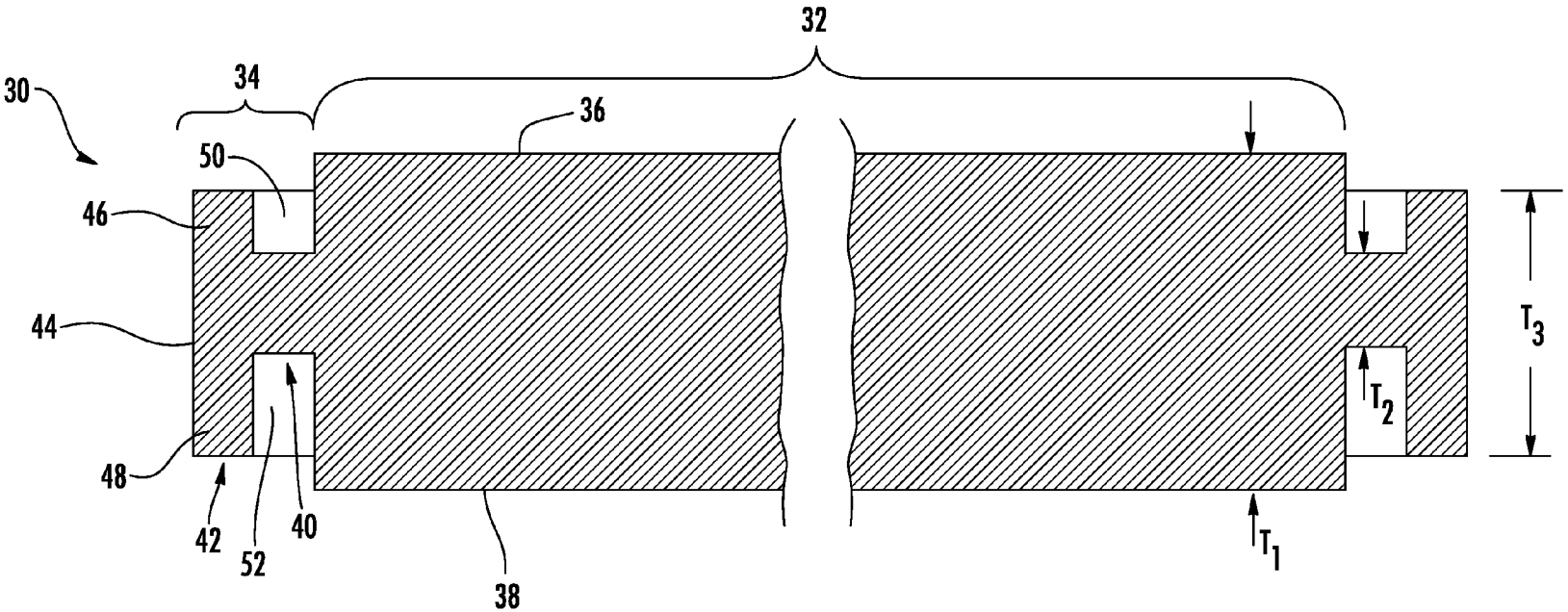
FIG. 3 is a cross sectional view of a spar laminate according to aspects of the invention.

The internal spar 26 can be made of a plurality of spar laminates 30 (only a single spar laminate 30 is shown in FIG. 2). Each spar laminate 30 can be generally airfoil shaped. One or more of the spar laminates 30 can include one or more passages (not shown) extending through their thickness, or one or more of the spar laminates 30 can be can be free of any through passages. Referring to FIG. 3, each spar laminate 30 can include a body portion 32 and a retention portion 34 adapted for engaging the external skin 28. The body portion 32 can include an upper surface 36 and an lower surface 38. The upper and lower surfaces 36, 38 can be substantially planar. The upper and lower surfaces 36, 38 can be substantially parallel to each other.

The retention portion 34 can have any suitable configuration. The retention portion 34 can include a bridge portion 40 extending from the body portion 32. The bridge portion 40 can transition into an engaging portion 42. The engaging portion 42 can extend generally transverse to the bridge portion 40.

In one embodiment, the retention portion 34 can be generally T-shaped in cross-section, as is shown in FIG. 3. In such case, the engaging portion 42 can include an upturn lip 46 and a downturn lip 48. In another embodiment, the engaging portion 42 can be configured as a substantially male or female dovetail (not shown), or it can be substantially spherical (not shown). The engaging portion 42 can define the outer peripheral surface 44 of the spar laminate 30.

The retention portion 34 can extend all the way around the body portion 32, or a plurality of retention portions 34 can be provided about the body portion 32 at any suitable spacing. One or more channels can be formed between the retention portion 34 and the body portion 32. For instance, as shown in FIG. 3, there can be an upper channel 50 formed between the upturn lip 46, the bridge portion 40 and the body portion 32. Likewise, a lower channel 52 can be formed between the downturn lip 48, the bridge portion 40 and the body portion 32. The channels 50, 52 can have any suitable shape or size.

The body portion 32 can have an associated thickness T1, the bridge portion 40 can have an associated thickness T2, and the engaging portion 42 can have an associated thickness T3. When referring to thicknesses T1, T2, T3, it is intended to mean the thickness of the given portion in the radial direction when the airfoil assembly 12 is installed in the engine. The thickness T2 of the bridge portion 40 can be less than the thickness T1 of the body portion 32. The thickness T3 of the engaging portion 42 can be greater than the thickness T2 of the bridge portion 40, but the thickness T3 of the engaging portion 42 can be less than the thickness T1 of the body portion 32.

The spar laminates 30 can be made of any suitable material. For instance, the spar laminates 30 can be made of a material with lower temperature capability than the material of the external skin 28. In one embodiment, the spar laminates 30 can be made of a nickel-based superalloy. The spar laminates 30 can withstand at least about 950 to about 1000 degrees Celsius. In one embodiment, each of the spar laminates 30 can be made of the same material. Alternatively, one or more of the spar laminates 30 can be made of a different material.

The spar laminates 30 can be made by any suitable process, such as by casting, machining, forging, etc. The spar laminates 30 can be substantially identical to each other, or at least one spar laminates 30 can be different from the other spar laminates 30 in one or more respects, including, for example, thickness, size, and/or shape. It should be noted that the uppermost spar laminate and the lowermost spar laminate in the airfoil assembly 12 can have different features from the other spar laminates 30, such as to facilitate engagement with the inner and outer shrouds 14, 16.

Figure 4:
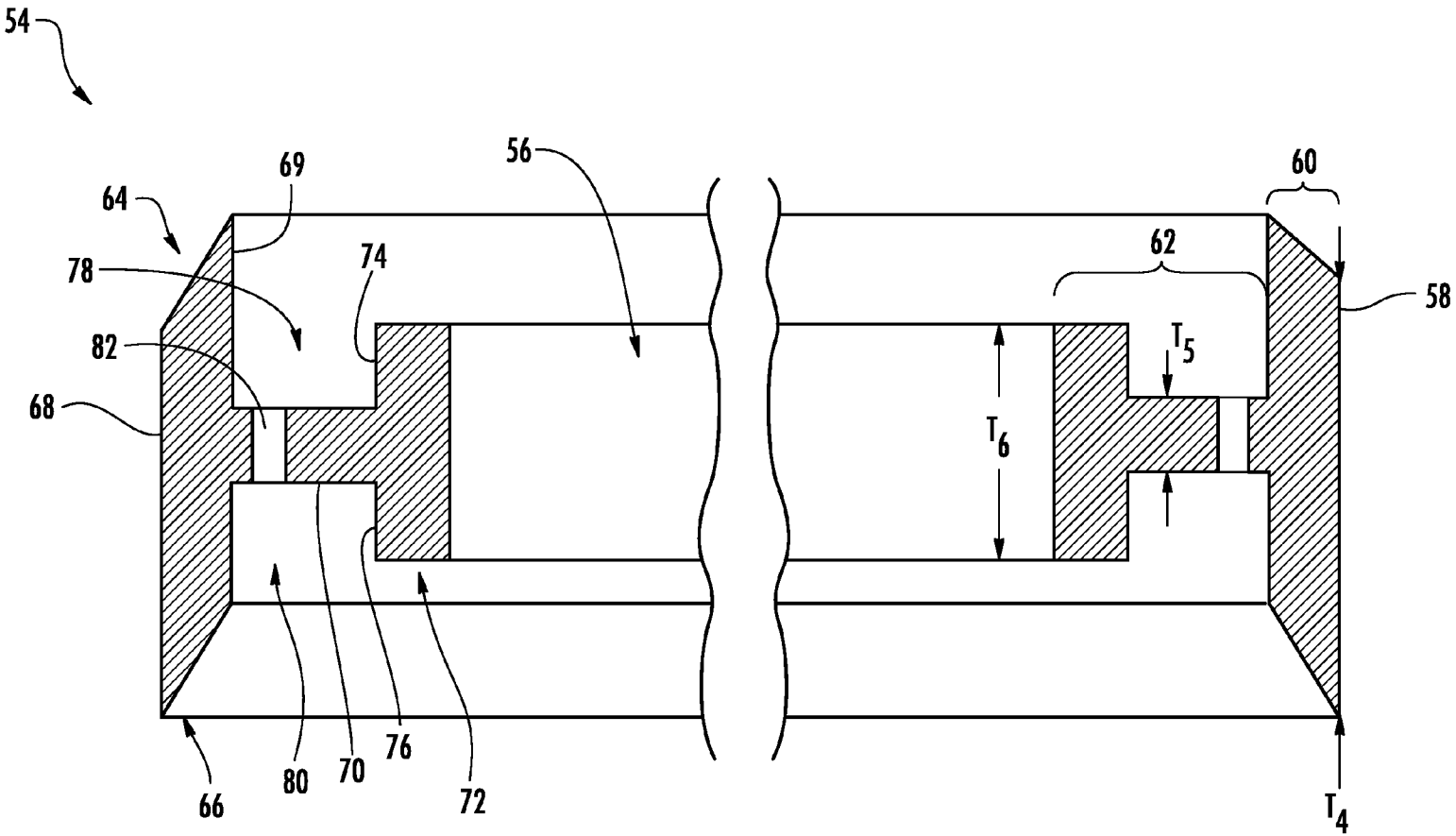
FIG. 4 is a cross-sectional view of a skin laminate according to aspects of the invention.

The external skin 28 can be made of a plurality of skin laminates 54. An example of a skin laminate 54 is shown in FIG. 4. Each skin laminate 54 can be generally airfoil shaped (as shown in FIG. 2). Each skin laminate 54 includes a generally open interior 56, which can be sized to receive a portion of at least one spar laminate 30. In one embodiment, the interior 56 can be sized to receive the body portion 32 of a spar laminate 30.

The skin laminates 54 can have any suitable configuration. In one embodiment, the skin laminates 54 can be generally H-shaped in cross-section, as shown in FIG. 4. Each skin laminate 54 can include an outer wall portion 60 and a retention portion 62. The outer wall portion 60 can include an upper end surface 64 and an lower end surface 66. The upper and lower end surfaces 64, 66 can be substantially flat. The upper and lower end surfaces 64, 66 can be substantially parallel to each other. The upper and lower end surfaces 64, 66 can be angled relative to horizontal, as is shown in FIG. 4. The outer wall portion 60 can include an outer peripheral surface 68, which can define the outer peripheral surface 21 of the airfoil assembly 12 according to aspects of the invention.

The retention portion 62 can have any suitable configuration. The retention portion 62 can include a bridge portion 70 extending inward from the outer wall 60. The bridge portion 70 can transition into an engaging portion 72. The engaging portion 72 can extend generally transverse to the bridge portion 70. The retention portion 62 can have any suitable configuration. The retention portion 62 can be sized, shaped and/or otherwise configured for substantial mating engagement with the retention portion 34 of the spar laminates 30.

In one embodiment, the retention portion 62 can be generally T-shaped in cross-section, as is shown in FIG. 4. In such case, the engaging portion 72 can include an upturn lip 74 and a downturn lip 76. In another embodiment, the engaging portion 72 can be configured as a substantially male or female dovetail (not shown), or it can be substantially spherical (not shown).

The retention portion 62 can extend along the entire inside of the outer wall portion 60, or a plurality of retention portions 62 can be provided about the inside of the outer wall portion 60 at any suitable spacing. One or more channels can be formed between the retention portion 62 and the outer wall 60. In the embodiment shown in FIG. 5, there can be an upper channel 78 and a lower channel 80. The channels 78, 80 can have any suitable shape or size.

The outer wall 60 can have an associated thickness T4, the bridge portion 70 can have an associated thickness T5, and the engaging portion 72 can have an associated thickness T6. When referring to thicknesses T4, T5, T6, it is intended to mean the thickness of the given portion in the radial direction when the airfoil assembly 12 is installed in the engine. The thickness T5 of the bridge portion 70 can be less than the thickness T4 of the outer wall 60. The thickness T6 of the engaging portion 72 can be greater than the thickness T5 of the bridge portion 70, but the thickness T6 of the engaging portion 72 can be less than the thickness T4 of the outer wall 60.

The bridge portion 70 of at least one of the skin laminates 54 can include at least one passage 82. In one embodiment, there can be a plurality of passages 82 distributed about the bridge portion 70. Each passage 82 can extend through the thickness T5 of the bridge portion 70, generally in the radial direction. The at least one passage 82 can have any suitable size and any suitable shape. For instance, the passage 82 can be generally circular, oval, square, triangular, rectangular, or polygonal in cross-sectional shape, just to name a few possibilities. When one or more passages 82 are provided in a plurality of skin laminates 54, the passages 82 in one skin laminate 54 can be identical to the passages 82 in other skin laminates 54, or at least one passage 82 can be different from the other passages in one or more respects, including any of those mentioned above.

The skin laminates 54 can be made of any suitable material. The skin laminates 54 can withstand at least about 1000 degrees Celsius. In one embodiment, the skin laminates 54 can withstand at least about 1300 to about 1400 degrees Celsius. The skin laminates 54 can be made of advanced generation single crystal superalloys, intermetallics, nickel-based intermetallics (such as Nickel Aluminide), refractory alloys, oxide dispersion strengthened alloys (such as PM2000, which is available from Plansee SE, Reutte, Austria). The skin laminates 54 can be made of a single crystal material or a polycrystal material.

In some instances, such as when the material of the skin laminate 54 exhibits poor environmental stability, at least a portion of the skin laminates 54 can be coated with an environmental barrier coating 58, which can be, for example, a refractory thermal barrier coating. In one embodiment, the entire skin laminate 54 can be coated with an environmental barrier coating 58. However, in some instances, only a portion of the skin laminate 54 may be coated with an environmental barrier coating 58.

The skin laminates 54 can be formed using any suitable process, such as by stamping, machining and/or forging. It will be appreciated that the manufacturing of the skin laminates 54 can be facilitated due to their relatively simple shapes, which, in turn, makes the use of more exotic materials more feasible.

The skin laminates 54 can be substantially identical to each other or at least one skin laminate 54 can be different in any of a number of respects, including, for example, thickness, size, shape. It should be noted that the uppermost skin laminate and the lowermost skin laminate can have different features from the skin spar laminates to facilitate engagement with the inner and outer shrouds 14, 16.

Figure 5:
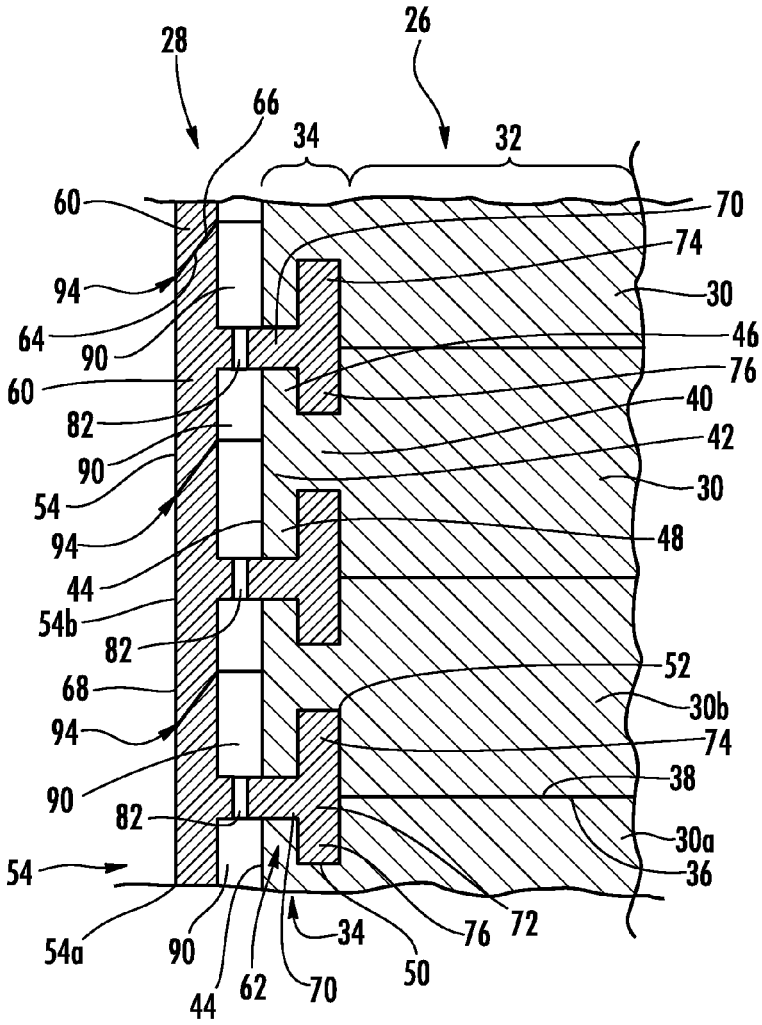
FIG. 5 is a sectional view of a portion of an airfoil assembly according to aspects of the invention, viewed along line 5-5 in FIG. 2.

The plurality of skin laminates 54 and the plurality of spar laminates 30 can be assembled in interlocking engagement to form the airfoil 12 according to aspects of the invention. An example of such an arrangement is shown in FIG. 5. In this way, the external skin 28 is located and locked in place by the laminates 30 of the internal spar 26. The term "interlocking engagement" and variants thereof is intended to mean that each spar laminate 30 engages each skin laminate 54 in such a way that the resulting interface between them is non-planar. Thus, the term "interlocking engagement" would exclude engagement by two substantially flat planar laminates, which have associated planar interface.

One manner of assembling the airfoil 12 will now be described. It will be understood that the invention is not intended to be limited to the described assembly method in any respect, including the order in which the steps are described.

Referring to FIG. 5, a first skin laminate 54*a* and a first spar laminate 30*a* can be brought together such that they interlockingly engage each other. More particularly, the retention portion 34 of the first spar laminate 30*a* can interlockingly engage the retention portion 62 of the first skin laminate 54*a*. For instance, the downturn lip 76 of the first skin laminate 54*a* can be received in the upper channel 50 of the first spar laminate 30*a*. In one embodiment, the downturn lip 76 can be substantially matingly received in the upper channel 50. The upturn lip 46 of the first spar laminate 30*a* can engage a portion of the engaging portion 72 and a portion of the bridge portion 70 of the first skin laminate 54*a*. If a passage 82 is provided in the bridge portion 70, the first spar laminate 30*a* does not block the passage 82.

A second spar laminate 30*b* can be brought together with the already engaged first skin laminate 54*a* and first spar laminate 30*a*. The retention portion 34 of the second spar laminate 30*b* can interlockingly engage the retention portion 62 of the skin laminate 54*a*. For instance, the upturn lip 74 of the first skin laminate 54*a* can be received in the lower channel 52 of the second spar laminate 30*b*. In one embodiment, the upturn lip 74 can be substantially matingly received in the lower channel 52. The downturn lip 48 of the spar second laminate 30*b* can engage a side of the engaging portion 72 and a portion of the bridge portion 70 of the first skin laminate 54*a*. If a passage 82 is provided in the bridge portion 70, the spar laminate 30*a* does not block the passage 82.

The lower surface 38 of the body portion 32 of the second spar laminate 30*b* can be substantially adjacent to the upper surface 36 of the first spar laminate 30*a*. In one embodiment, the lower surface 38 of body portion 32 of the second spar laminate 30*b* can abut the upper surface 36 of the first spar laminate 30*a*.

A second skin laminate 54*b* can be brought into engagement with second spar laminate 30*b* in the same manner that the first skin laminate 54*a* was brought into engagement with first spar laminate 30*a*. The lower end surface 66 of outer wall 60 of the second skin laminate 54*b* can abut the upper end surface 64 of the outer wall 60 of the first skin laminate 54*a* to form an interface 94. Preferably, the interface 94 is angled relative or horizontal and is as tortuous of a path a possible. The interface 94 can be planar or non-planar.

The above process can continue by the alternating inclusion of spar laminates 30 and skin laminates 54. When the airfoil is assembled, it will be appreciated that the retention portion 62 of each skin laminate 54 is interlockingly engaged between the retention portion 34 of two adjacent spar laminates. Significantly, the skin laminates 54 are held in place solely by their interlocking engagement with the spar laminates 30. As a result, no other structure or material—such as fasteners, adhesives, welds, bonding materials, etc.—is used or necessary.

The airfoil 12 can be assembled together with the inner and outer shrouds 14, 16. The airfoil 12 can be held together at its ends by engagement with the shrouds 14, 16 or in any other suitable manner. In one embodiment, the airfoil 12 can engage the shrouds 14, 16 such that a slight compressive force is applied to the airfoil 12.

The bridge portion 70 of the skin laminates 54 can extend sufficiently far away from the engaging portion 72 that, when assembled, the outer wall 60 of each skin laminates 54 can be spaced from the outer peripheral surface 44 of the spar laminates 30. Because of this spacing, a plurality of cavities 90 can be formed between the external skin 28 and the internal spar 26, as is shown in FIG. 5. Each cavity 90 can extend about the internal spar 26. Each cavity can be in fluid communication with a neighboring cavity 90 by way of the passages 82 in the bridge portion 70 of each skin laminate 54.

Any suitable coolant, such as air, can be supplied to the cooling cavities 90 such that the coolant is circulated between external skin 28 and internal spar 26, thereby providing near wall cooling to the airfoil 12, which has historically been difficult region of an airfoil to cool. The coolant source can be internal or external to the engine. In one embodiment, a coolant can be supplied from one of the radial ends of the airfoil 12.

The coolant can travel to other cavities 90 through the passages 82 in the skin laminates 54. The coolant can be exhausted from the airfoil 12 in any suitable manner. For instance, the coolant can exit the airfoil 12 through the trailing edge 20. To that end, trailing edge passages 92 can be provided in at least one of the skin laminates 54, as is shown in FIG. 2. Each trailing edge passage 92 can be in fluid communication with a respective cavity 90. Alternatively or in addition, the coolant can exit at interface between one of the shrouds 14, 16 and the adjacent end portion of the airfoil 12. The coolant can be exhausted at any point where such coolant could be beneficially used. It will be appreciated that when the interface 94 between the abutting end surfaces 64, 66 of the adjacent outer walls 60 of skin laminates 54 are angled relative to horizontal or are otherwise non-horizontal, loss of coolant from the cavity 90 can be minimized by creating a tortuous path for the coolant.

It will be appreciated that an assembly according to aspects of the invention can provide numerous advantages, including any of those mentioned above. For instance, the assembly according to aspects of the invention allows the use of alternative high temperature materials, which were not previously feasible to use in a vane. Such materials are only used in the locations where their properties are needed. Thus, the high cost and manufacturing difficulty of making an entire component of such a material is avoided. Thus, exotic materials can be used locally where needed without significantly adding to the cost of the part.

Further, it will be appreciated that the skin laminates 54 and the spar laminates 30, because they are made of different materials, can thermally expand or contract at different rates. However, by being assembled in accordance with aspects of the invention, the skin laminates 54 and spar laminates 30 can be thermally decoupled so that any differential in thermal expansion/contraction can be accommodated with minimal resultant stresses.

If a portion of an airfoil assembly according to aspects of the invention becomes damaged, only the damaged laminates need to be replaced while the remainder of the laminates can be reused. As a result, significant cost savings can be realized.

The foregoing description is provided in the context of one possible application for the system according to aspects of the invention. While the above description is made in the context of a turbine vane, it will be understood that the system according to aspects of the invention can be readily applied to any turbine engine component, particularly stationary components. Thus, it will of course be understood that the invention is not limited to the specific details described herein, which are given by way of example only, and that various modifications and alterations are possible within the scope of the invention as defined in the following claims.

What is claimed is:

1. A stationary turbine engine component comprising:

an internal spar made of a plurality of internal spar laminates;

an external skin made of a plurality of external skin laminates, each external skin laminate having an outer wall and a retention portion, wherein the retention portion of each external skin laminate is disposed between and in interlocking engagement with two neighboring internal spar laminates, whereby the external skin laminates are held in place by their interlocking engagement with the internal spar laminates;

wherein the internal sear laminates each include retention portions extending chordwise;

wherein the external sear laminates each include retention portions extending chordwise and configured to be placed in interlocking arrangement with the retention portions of the internal spar laminates; and wherein interfaces between adjacent internal spar laminates extend chordwise.

2. The stationary turbine engine component of claim 1 wherein each of the external skin laminates is made of one of advanced generation single crystal superalloys, intermetallics, nickel-based intermetallics, refractory alloys and oxide dispersion strengthened alloys.

3. The stationary turbine engine component of claim 1 wherein each of the external skin laminates is made of a material that can withstand at least about 1300 to about 1400 Celsius.

4. The stationary turbine engine component of claim 1 wherein at least a portion of the external skin laminates is coated with an environmental barrier coating.

5. The stationary turbine engine component of claim 1 wherein each internal spar laminate includes a body portion having at least one planar surface, wherein the planar surface of one internal spar laminate abuts the planar surface of the body portion of a neighboring internal spar laminate.

6. The stationary turbine engine component of claim 1 wherein each internal spar laminate has an outer peripheral surface, wherein the outer wall of each external skin laminate is spaced from the outer peripheral surface of each internal spar laminate that it is in interlocking engagement with such that a cavity is defined therebetween.

7. The stationary turbine engine component of claim 6 wherein the retention portion of each external skin laminate includes a bridge portion that extends inward from the outer wall, whereby the outer wall is spaced from the outer peripheral surface of each external skin laminate, wherein the bridge portion includes at least one passage extending therethrough.

8. The stationary turbine engine component of claim 1 wherein the outer wall of each external skin laminate includes an upper end surface and a lower end surface, wherein at least one of the upper end surface and the lower end surface abuts an opposite one of the upper end surface and the lower end surface of a neighboring external skin laminate.

9. The stationary turbine engine component of claim 8 wherein the interface formed between the abutting surfaces of the outer wall of neighboring external skin laminates, wherein the interface is angled relative to horizontal.

10. The stationary turbine engine component of claim 1 wherein the retention portion of each external skin laminate includes a bridge portion that extends inward from the outer wall, wherein the bridge portion transitions into a transverse engaging portion.

11. The stationary turbine engine component of claim 10 wherein the bridge portion and the engaging portion are generally T-shaped in cross-section.

12. The stationary turbine engine component of claim 1 wherein the external skin laminates are held in place solely by their interlocking engagement with the spar laminates, whereby no other structure is used to hold the external skin laminates in place.

13. A stationary turbine engine component comprising:

a first and a second internal spar laminate, each internal spar laminate including a body portion having a substantially planar upper surface and a substantially planar lower surface, the first and a second internal spar laminates further including a retention portion extending at least partially about the body portion, each retention portion including a bridge portion extending outward from the body portion, the bridge portion transitioning into a transverse engaging portion that defines an outer peripheral surface of each internal spar laminate; and an external skin laminate having an outer wall and a retention portion, the retention portion including a bridge portion extending inward from the outer wall, the bridge portion transitioning to a transverse engaging portion, the laminates being arranged so that the retention portion of the external skin laminate is disposed between and in interlocking engagement with the retention portion of first and second internal spar laminates, and so that the upper planar surface of the first internal spar laminate is substantially adjacent to the lower planar surface of the second internal spar laminate, and so that the outer wall of the external skin laminate is spaced from the outer peripheral surface of the first and second internal spar laminates;

wherein the retention portions of the internal spar laminates extend chordwise;

wherein the retention portions of the external spar laminates extend chordwise and are configured to be laced into interlocking arrangement with the retention portions of the internal spar laminates; and wherein interfaces between adjacent internal spar laminates extend chordwise and interfaces between adjacent external skin laminates extend chordwise.

14. The stationary turbine engine component of claim 13 wherein the retention portion of the first and second internal spar laminates is generally T-shaped in cross-section, and wherein the retention portion of the external skin laminate is generally T-shaped in cross-section.

15. The stationary turbine engine component of claim 13 wherein the external skin laminate is made of one of advanced generation single crystal superalloys, intermetallics, nickel-based intermetallics, refractory alloys and oxide dispersion strengthened alloys.

16. A stationary turbine engine component of claim 13 wherein the outer wall of the external skin laminate includes an upper end surface and a lower end surface, wherein the upper end surface and the lower end surface are angled relative to horizontal.

17. The stationary turbine engine component of claim 13 wherein the external skin laminate is held in place solely by its interlocking engagement with the first and second internal spar laminates.

18. A turbine vane assembly comprising:

an inner shroud;

an outer shroud; and an airfoil extending between and operatively engaging the inner shroud and the outer shroud; the airfoil including:

an internal spar made of a plurality of generally airfoil shaped internal spar laminates, each internal spar laminate including a body portion and a retention portion extending at least partially about the body portion;

an external skin made of a plurality of generally airfoil shaped external skin laminates, each external skin laminate having an outer wall and a retention portion, wherein the retention portion of each external skin laminate is disposed between and in interlocking engagement with the retention portion of two neighboring internal spar laminates, wherein each external skin laminate is held in place by interlocking engagement with the internal spar laminates, wherein at least one end of the outer wall of each external skin laminate abuts an end of the outer wall of a neighboring external skin laminate, wherein each external skin laminate is made of one of advanced generation single crystal superalloys, intermetallics, nickel-based intermetallics, refractory alloys and oxide dispersion strengthened alloys;

wherein the retention portions of the internal spar laminates extend chordwise;

wherein the retention portions of the external spar laminates extend chordwise and are configured to be placed into interlocking arrangement with the retention portions of the internal spar laminates; and wherein interfaces between adjacent internal spar laminates extend chordwise and interfaces between adjacent external skin laminates extend chordwise.

19. The turbine vane assembly of claim 18 wherein each internal spar laminate has an outer peripheral surface, wherein the retention portion of each external skin laminate includes a bridge portion that extends inward from the outer wall, the bridge portion transitioning into a transverse engaging portion, wherein the outer wall of each external skin laminate is spaced from the outer peripheral surface of each internal spar laminate that it is in interlocking engagement with, wherein a plurality of cavities are formed between the outer wall of the external skin laminates, the outer peripheral surface of the internal spar laminates and the bridge portion of each external skin laminate.

20. The stationary turbine engine component of claim 19 wherein one of the cavities is in fluid communication with a neighboring cavity by way of passages extending through the bridge portion of the external skin laminate separating the two cavities.

* * * * *